US005280815A

United States Patent [19]

Jones

[11] Patent Number: 5,280,815

[45] Date of Patent: Jan. 25, 1994

[54] PRODUCT FILLING MACHINE

[75] Inventor: James E. Jones, Golden, Colo.

[73] Assignee: PRC, Englewood, Colo.

[21] Appl. No.: 878,813

[22] Filed: May 5, 1992

[51] Int. Cl.[5] ..... B65B 3/00

[52] U.S. Cl. ..... 141/147; 141/181; 141/263; 141/265

[58] Field of Search ..... 141/2, 144, 145, 146, 141/147, 181, 182, 251, 258, 259, 260, 263, 265, 280; 74/55, 56, 122, 567, 569, 838

[56] References Cited

U.S. PATENT DOCUMENTS

| | | | |
|---|---|---|---|
| 989,546 | 4/1911 | Jensen . | |
| 1,054,610 | 2/1913 | Phelps . | |
| 1,860,220 | 5/1932 | Bauer | 141/182 |
| 2,206,935 | 7/1940 | Bauer | 141/146 |
| 2,356,176 | 8/1944 | Pechy | 141/147 |
| 2,433,061 | 12/1947 | Pearson et al. | 141/146 |
| 2,699,281 | 1/1955 | Duke | 226/76 |
| 3,189,062 | 6/1965 | Kazmierczak | 141/147 |
| 3,450,174 | 6/1969 | Fievet | 141/146 |
| 3,559,702 | 2/1971 | Riesenberg | 141/128 |
| 4,293,010 | 10/1981 | Winiasz | 141/392 |
| 4,337,802 | 7/1982 | Kennedy et al. | 141/1 |
| 4,445,549 | 5/1984 | Bernhard | 141/148 |
| 4,492,259 | 1/1985 | Sick et al. | 141/198 |
| 4,606,382 | 8/1986 | Biller et al. | 141/1 |
| 4,635,688 | 1/1987 | Graffin | 141/1 |
| 4,674,547 | 6/1987 | Simonazzi | 141/263 |
| 4,838,326 | 6/1989 | Colacci et al. | 141/147 |
| 4,957,147 | 9/1990 | Lowe | 141/83 |

OTHER PUBLICATIONS

Advertising Leaflet entitled "Bottom Filler" of PRC.

*Primary Examiner*—Ernest G. Cusick

*Attorney, Agent, or Firm*—Sheridan Ross & McIntosh

[57] ABSTRACT

A dual cam configuration is provided in a container filler machine. The filler machine preferably fills containers from their bottoms and includes at least one filling station assembly, each such assembly including a dispensing assembly and a positioning assembly. For controlling the filling process at each station, the cam configuration includes first and second cam tracks, each track being followed by a cam following assembly. For each station, the machine also preferably includes a single pneumatic cylinder assembly for simultaneously maintaining both cam following assemblies against their respective cam tracks.

32 Claims, 3 Drawing Sheets

PRODUCT FILLING MACHINE

FIELD OF THE INVENTION

The present invention relates to machines for filling containers with a desired product.

BACKGROUND OF THE INVENTION

Many specialized commercial high volume container filling machines such as can or bottle fillers are in many ways unduly complex. This is especially true of container filling devices that dispense a flowable product into a container but which also must satisfy some additional constraint such as dispensing the product into the bottom of the container, keeping the dispenser submerged while dispensing, or precisely measuring the amount of product to be dispensed into containers. In general, increased complexity leads to increased costs associated with filling machine operation. Greater costs for such machines can be attributable to setting the desired positions of various assemblies for a given container to be filled. Difficulties can also arise in making adjustments during operation.

In a typical container filling machine there are a plurality of continuous cam tracks providing a predetermined path that is followed by a plurality of "filling stations" such that each such station is designed to fill a single container with each cycle through the cam track path. The cam tracks must be designed and adjusted for each container's dimensions. In connection with some filling machines there are various spring tensions or pneumatic pressures that must be maintained to properly dispense products into the containers.

In U.S. Pat. No. 3,189,062 of KaZmierczak a liquid bottle filler is disclosed with a plurality of filling stations for precisely filling bottles with a liquid substance. The apparatus disclosed includes five cam tracks, and, for each bottle filling station: four cam followers, at least two springs and a cylinder/piston dispensing combination. Of the four cam followers, one rides between two cam tracks and causes the product dispenser nozzle to be lowered to the bottle opening for product dispensing and raised once dispensing has been completed. One of the two springs, a compression spring, is used in conjunction with this follower to provide shock absorption as the dispenser descends to contact the bottle opening. The second spring, a tension spring, supplies a force to the filling station dispensing piston in a direction causing the surrounding cylinder to remain filled with the substance to be dispensed. In addition, this second spring also urges a pair of filling station cam followers against their related cam tracks. One of these tracks causes the dispensing piston to dispense the bulk of the product while the second track causes the piston to dispense precisely the amount required. Finally, a fourth station cam follower governs a valve allowing the product to flow into the bottle to be filled.

In U.S. Pat. No. 3,559,702 of Riesenberg a liquid bottle filler is disclosed such that the dispensing process results in minimal substance turbulence. More precisely, the Riesenberg apparatus fills bottles with a liquid product by inserting a filling stem into each bottle for dispensing the liquid near the bottom of the container and once there is sufficient liquid in the bottle, the stem outlet remains submerged while being slowly withdrawn from the bottle thus providing a smooth non-turbulent flow of liquid into the bottle. The filling controls for this apparatus consists of two cam tracks, and, for each bottle filling station contained in the apparatus: at least four pneumatic cylinders, three with positive pressure, one with negative pressure.

In U.S. Pat. No. 4,838,326 of Colacci et al. an apparatus is disclosed for dispensing a flowable product into containers at high speed as the containers travel in a straight line on an adjacent conveyor. Although no special constraints are imposed upon the dispensing mechanism, the apparatus still requires five cams tracks, numerous pneumatic cylinders to press the top cam track against the filling station cam rollers as they come in contact with this track. In addition, each filling station requires: two cam followers, a piston/cylinder dispensing combination and a latching mechanism to keep the filling stations tightly sealed to one another as they are filled with the product.

There are also well known apparatuses, called "bottom fillers," for dispensing a flowable or viscous product into the bottom of containers in a manner for reducing the development of air pockets in the container. Most bottom fillers require four circular cam tracks, and, for each filling station: two cam followers and a cylinder/piston combination for dispensing the product. For each filling station, the dispensing piston is surrounded by its sleeve or cylinder. The piston is allowed to reciprocate within the sleeve. Thus, the piston can be forced to retreat to one end of the sleeve as a pressured amount of product is allowed to fill the sleeve. Subsequently, the piston is forced in the opposite direction as the product is dispensed into the bottom of a container. The formation of air pockets is reduced in a container during the filling process since the sleeve can move independently of the dispensing piston and thus the product filled sleeve can be inserted into the bottom of the container prior to the piston expelling the product from the sleeve. Independent movement of the piston and the sleeve is achieved by the two pairs of cam tracks mentioned above. One pair is used to control the movement of each dispensing piston. The other pair is used to control the movement of each dispensing sleeve. For a given dimensioned container, each of the four tracks typically has a unique contour. Thus, substantial labor can be involved in initially positioning and/or subsequently adjusting all four tracks for appropriate container filling. Moreover, because the cam followers are sandwiched between tracks, such bottom fillers typically cannot easily provide a "no-container, no-fill" mechanism. That is, it is not feasible to stop the filling step when a can is missing because the four track configuration does not lend itself to such control It would be advantageous to have container fillers that are both less complex to manufacture and require less labor to operate and maintain than those currently available. The present invention dynamically positions the dispensing mechanism within a container in a simple flexible manner. Embodied in an improved bottom filler, the apparatus requires only two cam tracks. One cam track for positioning the dispenser within the container and one cam track to cause an appropriate amount of product to be dispensed into the container. Furthermore, for each filling station, preferably a single pneumatic assembly supplies all the tension or pressure required for controlling the dispensing mechanism.

SUMMARY OF THE INVENTION

The present invention relates to a method and an apparatus for filling containers wherein each product dispenser can be dynamically positioned within the container while dispensing the product. The invention provides a novel dual cam configuration wherein two cam tracks control the dispensing operation for a plurality of container filling stations. Each filling station includes a product dispensing assembly. Each such assembly includes both a dispenser for delivering a predetermined amount of product into a container, and a positioning mechanism for positioning the dispenser during delivery. The dispenser is controlled by one of the cam tracks, the dispensing cam, while the positioning mechanism is controlled by the other cam track, the positioning cam. Thus, for each filling station, the dual cam configuration, in addition, includes a pair of cam follower assemblies. As each filling station traverses a predetermined path within the container filler, one such assembly follows the contour of the dispensing cam and therefore, via appropriate connectors, controls the dispenser. The other assembly follows the contour of the positioning cam and therefore, via appropriate connectors, controls the positioning mechanism. In following their respective cams, each cam following assembly includes a cam roller for rotationally contacting and following the cam. In addition, each filling station includes preferably a single fluid pressure device that is also part of the dual cam configuration. The fluid pressure device is incorporated into each filling station in such a manner as to simultaneously urge both cam rollers against their respective cams. Thus, as the filling stations traverse their designated path during operation of the container filler, station cam followers follow the contour of their respective cams and therefore cause the product to be dispensed into containers.

In a preferred embodiment, a pneumatic cylinder embodies the fluid pressure device for each filling station. The cylinder supplies a separating force that urges the cam follower assemblies including their cam rollers in substantially opposite directions. The cam tracks are positioned such that the separating force causes the cam rollers to be urged against their respective cam tracks. The cam tracks must be positioned such that the direction of force exerted on their respective cam rollers urges the rollers against the appropriate cam track. In another embodiment, the fluid pressure device can be embodied as a compression spring. However, the preferred pneumatic cylinder has the advantage that the pressure or tension can be easily adjusted or eliminated entirely during cam adjustments.

When the preferred dual cam configuration is incorporated into a bottom filler, the resulting design provides significant advantages over previous bottom fillers. In particular, the following advantages accrue:

a. A "no-container, no-fill" feature can be more readily incorporated into the bottom filler. Since neither cam follower is locked between two cam tracks, the piston/sleeve dispensing combination can be locked in a position such that the sleeve does not receive the product during the sleeve filling step or phase.

b. The cams and cam followers last substantially longer since there is only a single track that the follower must contact.

c. The filling stations are more easily cleaned. Bottom fillers with four cam tracks are supported by a cam track frame that surrounds the bottom filler. Thus, cleaning the filling stations is at least awkward and can necessitate dismantling some portion of the cam frame and/or its cams.

d. The improved bottom filler is quieter during operation. Since each cam follower is virtually always in contact with its cam track, the noise associated with cam followers oscillating between a pair of tracks is eliminated.

e. Assembly and adjustment of the cam tracks is more readily accomplished since there are only two tracks and a set distance between a double cam configuration for proper roller clearance is not necessary.

BRIEF DESCRIPTION OF THE DRAWINGS

The present invention will be better understood from the detailed description given below and the accompanying drawings which are given by way of illustration only, and thus, are not limitative of the present invention and wherein.

DETAILED DESCRIPTION

Figure 1:
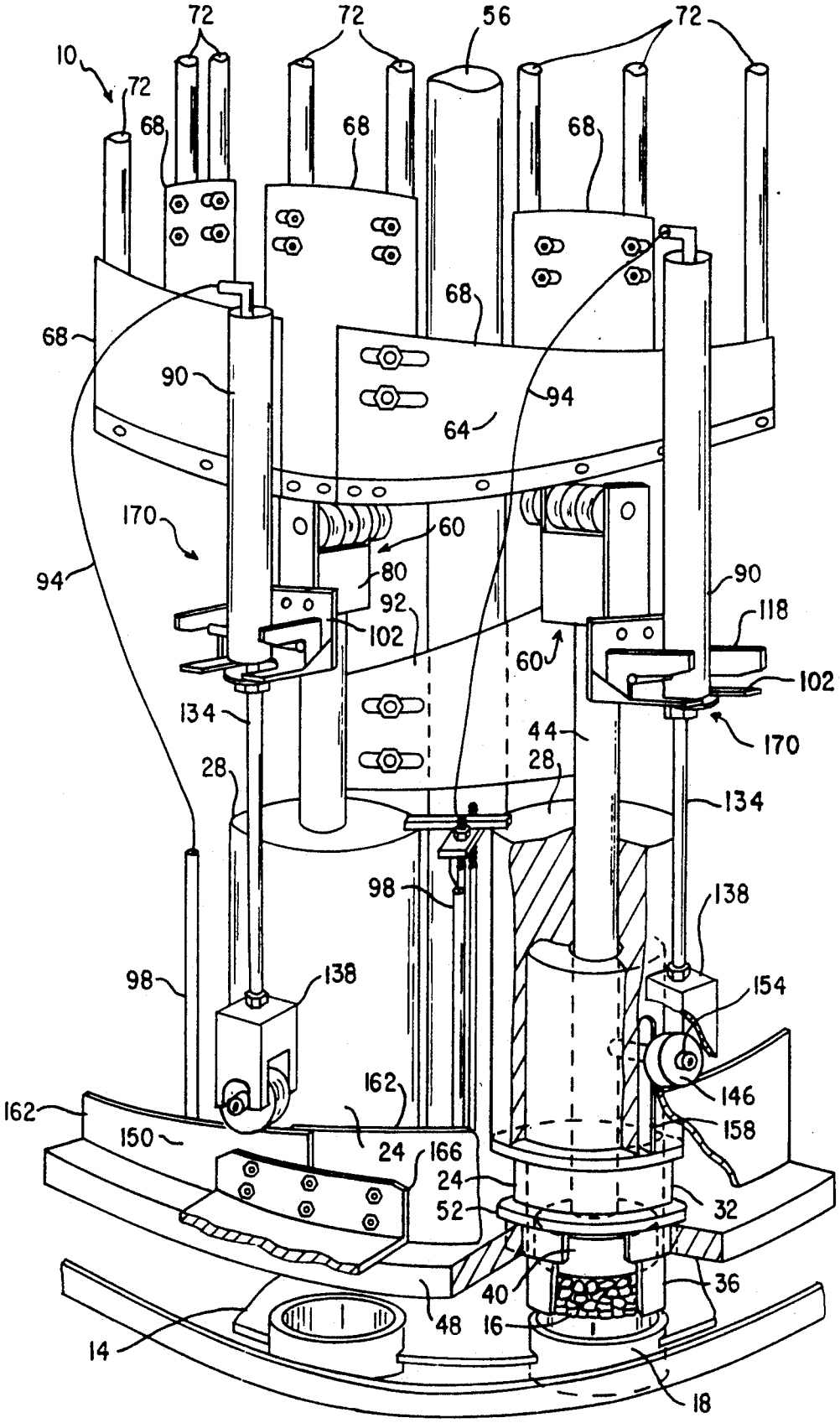
FIG. 1 is a perspective view of the bottom filler machine illustrating the two cam tracks and the pneumatic cylinder assembly.

With reference to FIG. I, a preferred embodiment of the invention is presented as container filler machine I0. The base of the container filler machine I0 includes a circular container star wheel 14 for positioning a plurality of containers 18 in a circular fashion equally spaced around the star wheel 14. FIG. 1 shows two such containers 18. Each container 18 is cylindrical and is oriented such that the open end is facing upward. A product dispensing assembly 24 is positioned above each container on the star wheel 14. The assembly 24 includes: a vertically movable product positioning sleeve 36 for containing the product 16 immediately prior to being deposited into a container 18, a piston head 40 movably fitted within sleeve 36 for pushing the product 16 in sleeve 36 downward into container 18, a piston shaft 44 for supplying a downward force to piston head 40 to which shaft 44 is connected, a vertically stationary dispenser casing 32 snugly surrounding sleeve 36 and a dispenser bushing housing 28 resting upon and attached to casing 32 such that housing 28 surrounds the upper portion of sleeve 36. As shown in the cutaway portion of FIG. 1, each dispensing assembly 24 protrudes through and is supported by a circular support plate 48. A flange 52 bottoms out on top of the plate 48. The container star wheel 14 and the plate 48 have their centers on a vertical axis that is also coincident with the vertical axis of the central column 56. Although not shown, the central column 56 penetrates and supports both plate 48 and star wheel 14 such that they can rotate about column 56. Thus, column 56 also indirectly rotatably supports the dispenser assemblies 24.

The upper end of shaft 44 of each assembly 24 is connected to a cam follower assembly 60. When rotating about column 56, cam follower assembly 60 follows the bottom contour of stationary circular cam assembly 64. Thus, the contour of cam assembly 64 ultimately determines when piston 40 is forced downward to deposit a predetermined amount of product 16 in a container 18. Circular cam assembly 64 includes adjustable arcuate cam tracks 68, well known in the art. Each cam track 68 is adjustably attached to cam supports 72 arranged circularly around column 56 and supported by an outer container filler machine 10 framework (not shown).

Figure 2:
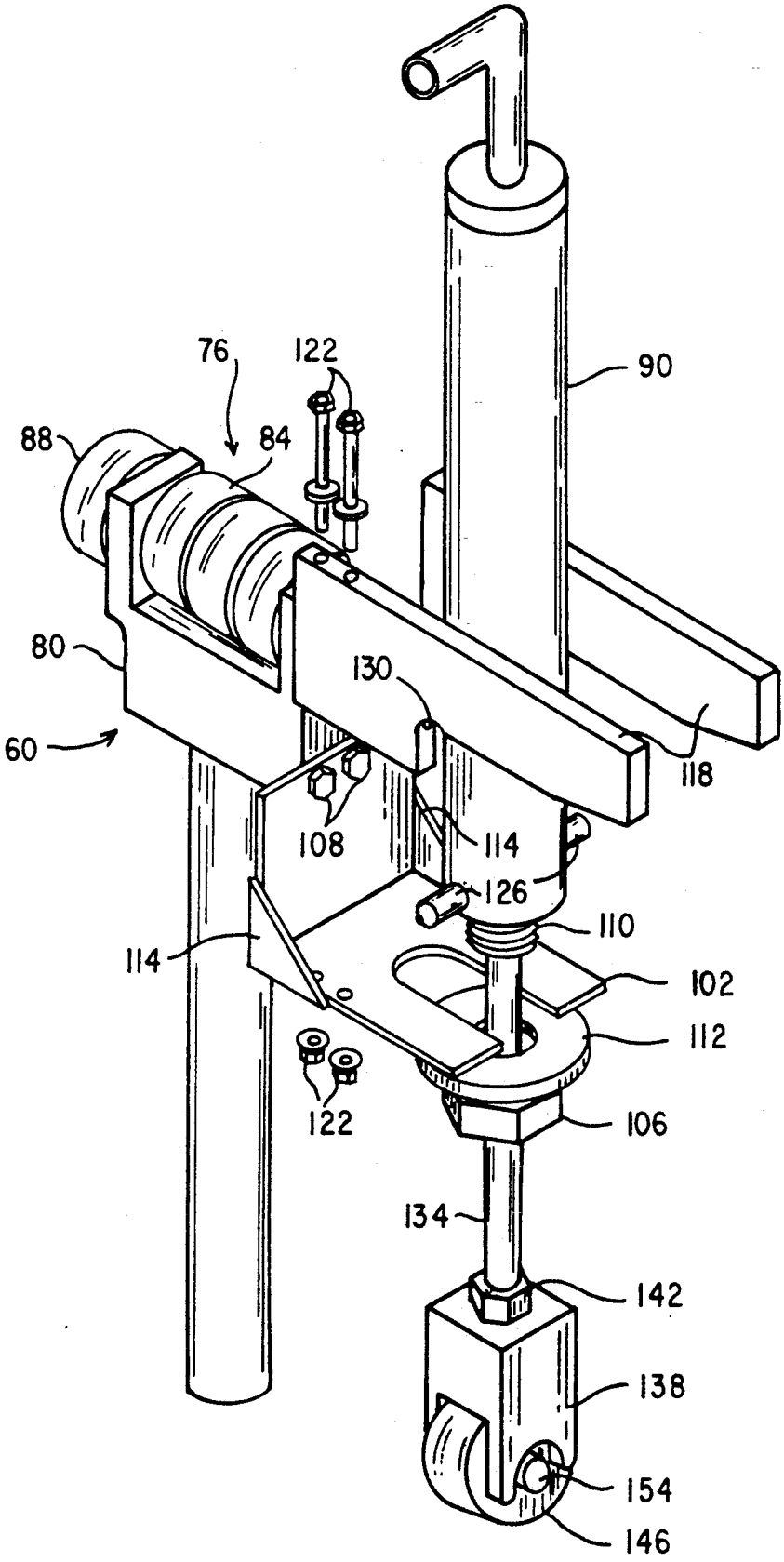
FIG. 2 is a more detailed perspective view of the pneumatic cylinder assembly and attachments for achieving the separating force.

Returning to cam follower assembly 60, as best illustrated in FIG. 2, each assembly 60 includes a cam roller subassembly 76 containing a plurality of rollers 84 and a roller bracket 80 to which the cam roller subassembly 76 is attached In the current embodiment, the cam roller subassembly 76 includes three rollers 84 held by bracket 80 and a single safety roller 88 held outside of bracket 80. All four rollers are in line and rotate independently about the same axle (not shown). In certain abnormal circumstances as explained below, e.g. the loss of air to the system, the roller 88 will follow the top contour of safety cam 92 (FIG. 1). In normal operation, at least one of the rollers 84 follows a cam track 68 of cam assembly 64 and roller 88 will not be used.

For each cam follower assembly 60, there is a single pneumatic cylinder 90 supplying the force urging the rollers 84 against cam 64. This cylinder is preferably supplied with pressurized air via supply line 94 from air pressure source 98. As best disclosed in FIG. 2, cylinder 90 is removably attached to connector 102 by fastener 106 being threaded onto cylinder bolt fitting 110 using a washer 112. The washer 112 underlies the slot defined by the two fingers of the connector 102. Connector 102 is removably attached to bracket 80 via some suitable means, for example, bolts 108. Since there are both upward and downward vertical forces applied to connector 102, as will be discussed below, connector 102 is appropriately reinforced by flanges 114 disposed between the horizontal and vertical members of connector 102. To assure that cylinder 90 maintains a vertical orientation and is also firmly connected to connector 102, two alignment stays 118 are identically and removably attached to opposing sides of connector 102 via bolts 122. These alignment stays 118 are designed such that an amount of torque placed on the pneumatic cylinders, after bolt 106 has been loosened, causes sufficient deflection in the alignment stays 118 whereby the pneumatic cylinders can be removed and set aside for station clean-up Protruding horizontally from the lower portion of cylinder 90 are two alignment stops 126. Each of the stops 126 fits tightly into a stop seat 130 of each alignment stay 118. Any upward force exerted on cylinder 90 will cause alignment stops 126 to exert a force on stop seats 130 thus causing cylinder 90 to maintain a vertical orientation. Protruding from the lower end of cylinder 90 is a movable cylinder rod 134. This rod is forced downward, out of cylinder 90 by the pressurized air within cylinder 90. The lower end of rod 134 is suitably attached to a cam follower assembly 138 via rod attachment 142. A cam roller 146 is connected to the rod 134 and, in normal operation, is urged downward by the rod 134. As shown in FIG. 1, cam follower assembly 138 follows the contour of stationary circular cam assembly 150 as rod 134 and cylinder 90 rotate about column 56 in unison with dispenser assembly 24 and cam follower assembly 60. Cam follower 138 includes axle 154, shown best in FIG. 1. The outermost end of axle 154 operates to rotatably support cam roller 146 and therefore follows the contour of cam assembly 150. The opposite end of axle 154 extends through housing 28 via vertical slot 158 and is affixed to sleeve 36 such that the vertical position of sleeve 36 is determined by the vertical position of axle 154 and thus indirectly by cam assembly 150. Returning to cam assembly 150, it includes adjustable cam tracks 162, in a similar fashion to cam assembly 64. Cam assembly 150 is supported and held stationary by a plurality of cam supports 166, one of which is shown in FIG. 1. Supports 166 are suitably attached to cam assembly 150 and to the outer container filler machine 10 framework (not shown).

Since the combination, including a dispenser assembly 24, its uniquely associated cylinder 90, rod 134, connector 102, cam follower assembly 60 and cam follower assembly 138 function as a container filling unit, it is useful to refer to each combination as a "filling station" 170 (FIG. 1). Thus, each filling station 170 operates independently of others and rotates about column 56 with both cam follower assemblies 60 and 138 being urged by the air pressure contained within a single cylinder 90 to follow the contour of cams 64 and 150 respectively.

Figure 3:
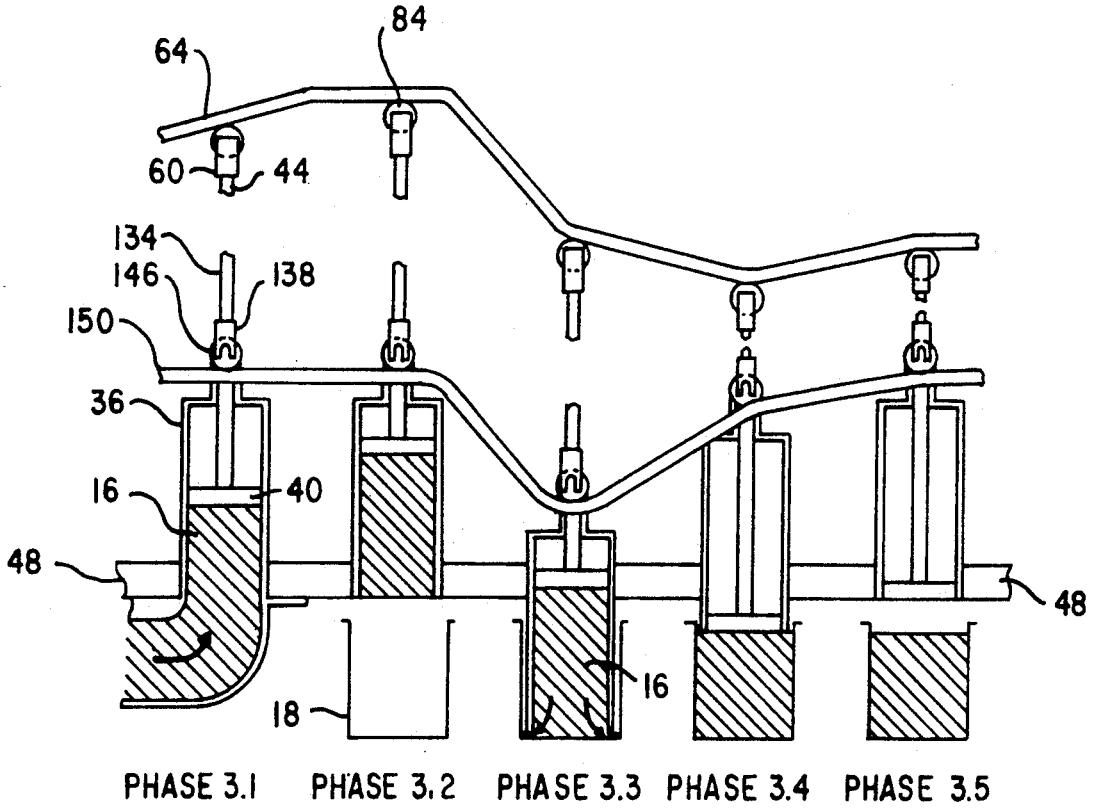
FIG. 3 is a diagram illustrating the cycle of the bottom filler machine when filling a container

During normal operation of container filler machine 10, a plurality of product filling stations 170 are urged to rotate continuously about column 56 by a suitable power source not illustrated. During each rotation, each station 170 cycles through at least five phases. These phases are illustrated in a simplified manner in FIG. 3. For illustration purposes, FIG. 3 presents the cam assemblies 64 and 150 as rails or tracks and a filling station 170 is represented by only its sleeve 36, piston head 40 and cam follower assemblers 60 and 138, together with their related piston shaft 44 and rod 134 respectively. During phase 3.1 the product 16, under pressure, is urged into the sleeve 36 while initially piston head 40 is flush with the lower end of sleeve 36. As product 16 begins filling the sleeve 36, piston head 40 moves upward, thus urging shaft 44 and cam follower assembly 60 upward. The upward movement is allowed since cam assembly 64 or portion control is configured to provide a predetermined control height corresponding to the amount of product 16 that is to be deposited in a container 18. During phase 3.2 the product filled sleeve 36 is sealed off at the bottom by a suitable means to prevent product loss while an empty container 18 is aligned beneath the sleeve 36. During phase 3.3 both the sleeve 36 and the piston 40 are synchronously forced downward relative to the container 18, which is positioned below the filling station 170. The downward urging is accomplished by followers 60 and 138 following cams 64 and 150 respectively. Note that sleeve 36 has a diameter small enough to allow it to fit into container 18 and allow air within the container to escape as the product filled sleeve 36 moves to the bottom of the container 18. In phase 3.4, cam follower 60 continues somewhat further downward causing piston 40 to continue downward while follower 138 moves upward causing sleeve 36 to retract from container 18. Thus, the product 16 is forced out of sleeve 36 and piston 40 compacts product 16 sufficiently to remove any remaining air. In phase 3.5, both cam followers 60 and 138 follow their respective cams upward. Both the piston 40 and the sleeve 36 retract completely clear of the product filled container 18. Thus, the container 18 can now be removed from container filler 10 while sleeve 36 and piston 40 remain in this last position in preparation for phase 3.1 to once again commence.

It can be seen from the above description that each filling station 170 has a single pressurized cylinder 90 providing the separating force causing both cam followers 60 and 138 to follow their respective cams as the station rotates through the phases of FIG. 3. That is, as the pressure in cylinder 90 forces rod 134 to extend downward causing follower 138 to press against cam 150, the result is an equal and opposite force that is directed upward. This upward force on cylinder 90 is conveyed to connector 102 via the cylinder attachments: fastener 106 and stays 118. However, since connector 102 is firmly attached to bracket 80 of cam follower 60, this upward force is transferred to follower 60 causing cam roller subassembly 76 to follow cam 64. It should also be noted that the pressurized air of cylinder 90 can be constant as station 170 rotates through the phases of FIG. 3. All that is needed is sufficient pressure to keep followers 60 and 138 in constant contact with their respective cams. Thus, the fluid pressure supplied to each pressure source 98 can be independent of container filler machine 10 since there is no need to coordinate cylinder 90 pressure with any container filler machine 10 actions.

In the event that a cylinder 90 looses pressure, the current embodiment of container filler machine 10 requires that both the sleeve 36 and the piston 40 remain above the support plate 48 during the product filling phase 3.1, the container 18 positioning phase 3.2 and the container 18 removal period which can be concurrent with phase 3.5. If this requirement is not met, severe damage to the container filler machine 10 may occur. In the case of the sleeve 36, note that since the cam follower 138 to which it is connected is supported by cam 150, there is no possibility of sleeve 36 remaining below plate 48 at inappropriate times. However, this is not the case for piston 40. Without the upward force derived from the pressure in cylinder 90, follower 60, shaft 44 and piston 40 have only frictional and gravitational forces applied to them. Thus, there is the possibility piston 40 could extend through plate 48 at an inappropriate time due to gravity. To stop this possibility from occurring, safety cam 92 is positioned such that as cam follower 60 falls away from cam 64, the safety roller 88 will contact the top of safety cam 92, thus preventing unwanted movement of the piston 40 below plate 48.

It should be understood that the dual cam configuration embodied in separating force cylinder 90, cam followers 60 and 138, and cams 64 and 150 need not apply only to container filling apparatuses that include a dispensing assembly 24 such as embodied in FIGS. 1 and 3. That is, such a dual cam configuration can be used wherever a container filler dynamically positions the dispenser mechanism during a container filling operation. For example, the dual cam configuration can be utilized in canning devices, bottle filling devices, or drum filling devices.

It is also noted that the separation force provided by cylinder 90 could, instead, be provided by a mechanical means such as a spring means.

The foregoing discussion of the invention has been presented for purposes of illustration and description. Further, the description is not intended to limit the invention to the form disclosed herein. Consequently, variations and modifications commensurate with the above teachings, within the skill and knowledge of the relevant art, are within the scope of the present invention. The embodiment described hereinabove is further intended to explain the best mode presently known of practicing the invention and to enable others skilled in the art to utilize the invention in such, or other embodiments, and with the various modifications required by their particular applications or uses of the invention. It is intended that the appended claims to be construed to include alternative embodiments to the extent permitted by the prior art.

What is claimed is:

1. A container filling apparatus, comprising:

first means for dispensing product for receipt by a container, said first means including a positioner means and at least one dispenser means for causing release of the product into the container from said positioner means, said positioner means positioning the product for release into the container, said dispenser means and said positioner means both in contact with the product;

second means for controlling said first means, said second means including:

means for moving at least one of said dispenser means, said positioner means and the container in a first direction;

dispensing cam means and a dispensing cam follower means for operatively controlling when said dispenser means releases the product into the container;

positioning cam means and a positioning cam follower means for operatively controlling the position of said positioner means;

single force generating means for applying substantially continuously during the filling operation:

(a) a first force of at least a predetermined magnitude to said dispensing cam follower means for engaging said dispensing cam means, said first force urging said dispensing cam follower means to move in substantially a single second direction, said second direction different from said first direction; and (b) a second force of at least a predetermined magnitude to said positioning cam follower means for engaging said positioning cam means, said second force urging said positioning cam follower means to move in substantially a single third direction, said third direction different from said first direction.

2. An apparatus, as claimed in claim 1, wherein:

said dispensing cam means includes a first cam track, said dispensing cam follower means includes a first cam roller for engaging and following said first cam track, said positioning cam means includes a second cam track and said positioning cam follower means includes a second cam roller for engaging and following said second cam track.

3. An apparatus, as claimed in claim 1, wherein:

said first and second forces are in substantially opposite directions.

4. An apparatus, as claimed in claim 1, wherein said force generating means includes:

force means;

first attachment means attached to said force means at a first position for conveying said first force to said dispensing cam follower means;

second attachment means attached to said force means at a second position, different from said first position, for conveying said second force to said positioning cam follower means.

5. An apparatus, as claimed in claim 4, wherein:

said force means includes a pneumatic fluid pressure means.

6. An apparatus, as claimed in claim 4, wherein:

said first and second attachment means are urged apart during normal operation of the apparatus.

7. An apparatus, as claimed in claim 1, wherein said first means includes:

first connector means for connecting said dispensing cam follower means to said dispenser means.. such that the position of said dispensing cam follower is conveyed to said dispenser means for determining when the product is released into the container;

second connector means for connecting said positioning cam follower means to said positioner means such that the position of said positioning cam follower is conveyed to said positioner means for determining when the next amount of the product is to be released.

8. An apparatus, as claimed in claim 7, wherein:

said dispenser means includes a piston head, said positioner means includes a movable sleeve within which said piston head reciprocates, said first connector means includes a shaft connecting said dispensing cam means to said piston head and said second connector means includes an axle extension.

9. A bottom filling apparatus for use with containers, comprising:

first means for dispensing a product for receipt by a container, said first means including a reciprocating piston head having a face for contacting the product to be dispensed, a sleeve movable in first and second directions during operation of the apparatus, said piston head is in slidable contact with an inner surface of said sleeve such that, as said piston head reciprocates within said sleeve, said sleeve is filled with the product, urged to substantially the bottom of the container and emptied of the product; and second means for controlling said first means, said second means including cam means and cam following means for engaging said cam means, said second means further including pneumatic means for applying a force to said cam following means in substantially a single direction during said movement of said sleeve in both said first and second directions.

10. An apparatus, as claimed in claim 9, wherein:

said first means includes a shaft connected to said piston head, said shaft also being connected to said cam following means, said shaft being moved in response to movement of said cam following means, said sleeve also being moved in response to movement of said cam following means.

11. An apparatus, as claimed in claim 10, wherein:

said cam following means includes a first cam follower and a second cam follower, said shaft being connected to said first cam follower and said sleeve being connected to said second cam follower.

12. An apparatus, as claimed in claim 11, wherein:

said cam means includes first and second cam tracks, said first cam track being spaced from said second cam track, said first cam follower contacting said first cam track using said pneumatic means and said second cam follower contacting said second cam track using said pneumatic means, said first and second cam tracks being the only tracks contacting said first and second cam followers during normal operation of the a

13. An apparatus, as claimed in claim 9, wherein:

said cam means includes a safety cam for engaging said cam follower means when an unwanted fault occurs in said means.

14. An apparatus, as claimed in claim 11, wherein:

each of said first and second cam followers includes at least a first roller with each of said first rollers being movable along said cam means.

15. An apparatus, as claimed in claim 8, wherein:

said cam means includes first and second cam tracks and said cam follower means includes first and second cam followers, said first cam follower engaging a lower surface of said first cam track and said second cam follower engaging an upper surface of said second cam track during normal operation of the apparatus.

16. An apparatus, as claimed in claim 8, wherein:

said cam follower means includes first and second cam followers and said pneumatic means is connected to a third means for causing separation relative to each other of said first and second cam followers.

17. An apparatus, as claimed in claim 16, wherein:

said third means includes means for interconnecting portions of said pneumatic means with said cam follower means wherein movement of said pneumatic means causes movement of said cam follower means.

18. An apparatus, as claimed in claim 9, wherein:

said cam means includes first and second cam tracks and said cam follower means includes first and second cam followers, and wherein a substantially equal magnitude of force is applied to said first and second cam followers to contact said first and second cam tracks, respectively, using said pneumatic means.

19. An apparatus, as claimed in claim 9, wherein:

said pneumatic means provides a force of pressurized air and includes a cylinder and a rod, said rod being connected to said cam follower means wherein movement of said rod causes movement of said cam follower means.

20. An apparatus, as claimed in claim 9, wherein:

said pneumatic means includes a cylinder and a rod and said cam follower means includes first and second cam followers, said cylinder being attached to said first cam follower by a first attachment means such that said force of pressurized air on said cylinder causes a first force on said first cam follower and said rod being attached to said second cam follower by a second attachment means such that said force of pressurized air on said cylinder causes substantially equal magnitude of force as said first force on said second cam follower.

21. An apparatus, as claimed in claim 20, wherein:

said cam means includes first and second cam tracks, wherein said force of pressurized air is used in separating said first and second cam followers so that said first cam follower contacts said first cam track and said second cam follower contacts said second cam track.

22. An apparatus, as claimed in claim 21, wherein:

said first cam follower contacts a lower surface of said first cam track and said second cam follower contacts an upper surface of said second cam track.

23. An apparatus, as claimed in claim 9, wherein:

said sleeve is connected to said cam following means wherein movement of said cam following means causes movement of said sleeve.

24. An apparatus, as claimed in claim 9, wherein:

said pneumatic means includes a pneumatic cylinder having a nozzle for receiving pressurized air, said cam means includes first and second cam tracks and said cam following means includes first and second cam followers, wherein said same pneumatic cylinder is used to cause movement of each of said first and second cam followers towards each of said first and second cam tracks, respectively.

25. A method for filling a container using an apparatus that includes a sleeve, a piston head, at least first and second cam followers and at least first and second cam tracks, comprising:

rotating at least one of said sleeve, said piston head, said cam followers and said cam tracks using a means for rotating;

receiving product within said sleeve;

locating said piston head at a predetermined position within said sleeve during said receiving step;

dispensing the product from said sleeve adjacent a container bottom; and using force generating means, different from said means for rotating, for applying:

(a) a first force, of at least a predetermined magnitude, to said first cam follower such that said first cam follower follows said first cam track substantially continuously during movement of said first cam follower; and (b) a second force, of at least a predetermined magnitude, to said second cam follower such that said second cam follower follows said second cam track substantially continuously during movement of said second cam follower.

26. A method, as claimed in claim 25, wherein:

said step of dispensing includes moving said first cam follower relative to said first cam track with said first cam follower being connected to a shaft that is connected to said piston head with said first cam follower engaging a lower surface of said first cam track.

27. A method, as claimed in claim 26, wherein:

said step of dispensing includes moving said second cam follower relative to said second cam track with said sleeve being connected to said second cam follower and said second cam follower contacting an upper surface of said second cam track.

28. A method, as claimed in claim 25, wherein:

said step of dispensing includes moving said sleeve in each of first and second directions in which said second direction is substantially opposite said first direction and said step of using includes applying said force resulting from said force generating means to said first cam follower in substantially the same direction while said sleeve is moved in each of said first and second directions and while the product is being dispensed into said container.

29. A method, as claimed in claim 25, wherein:

said step of dispensing includes moving said first cam follower, which is connected to said piston head, and said step of dispensing also includes moving a second cam follower, which is connected to said sleeve, wherein said step of using includes separating said first cam follower from said second cam follower by moving said first and second cam followers toward said first and second cam tracks, respectively.

30. A container filling apparatus, comprising:

first means for dispensing product for receipt by a container, said first means including a positioner means and at least one dispenser means for causing release of the product into the container from positioner means, said positioner means for positioning the product for release into the container, said dispenser means and said positioner means both in contact with the product;

second means for controller said first means, said second means including:

dispensing cam means and dispensing cam follower means for operatively controlling when said dispenser means releases the product into the container;

positioning cam means and positioning cam follower means for operatively controlling the position of said positioner means; and single force generating means for applying a first force to said dispensing cam follower means for engaging said dispensing cam means and also for applying a second force to said positioning cam follower means for engaging said positioning cam means, said force generating means including force means, first attachment means attached to said force means at a first position for conveying said first force to said dispensing cam follower means and second attachment means attached to said force means at a second position, different from said first position, for conveying said second force to said positioning cam follower means, said first and second attachment means being urged apart during normal operation of the apparatus, said force means including a pneumatic cylinder and a rod that movably extends from said cylinder under pneumatic pressure within said cylinder and said first attachment means is affixed to said cylinder and said second attachment means is affixed to said rod.

31. A method for filling a container using an apparatus that includes a sleeve, a piston head and at least two cam tracks, comprising:

receiving product within said sleeve;

locating said piston head at a predetermined position within said sleeve during said receiving step;

dispensing the product from said sleeve adjacent a container bottom; and using a single force generating means during at least one of said receiving, locating and dispensing steps, causing movement of said piston head controlled by said first cam track and movement of said sleeve controlled by said second cam track, said force generating means including a single pneumatic cylinder for applying force from pressurized air to a first cam follower and a second cam follower such that said first cam follower follows said first cam track and said second cam follower follows said second cam track.

32. A method for filling a container using an apparatus that includes a sleeve, a piston head and at least two cam tracks, comprising:

receiving product within said sleeve;

locating said piston head at a predetermined position within said sleeve during said receiving step;

dispensing the product from said sleeve adjacent a container bottom, said step of dispensing including moving a first cam follower, which is connected to said piston head and moving a second cam follower, which is connected to said sleeve; and using a single force generating means, during at least one of said receiving, locating and dispensing steps, for causing movement of said piston head controlled by said first cam track and movement of said sleeve controlled by said second cam track, said step of using including separating said first cam follower from said second cam follower by moving said first and second cam followers toward said first and second cam tracks, respectively, said step of separating including applying pressurized air from a source of pressurized air and moving said first and second cam followers in opposite directions and thereby causing movement of said piston head and said sleeve.

* * * * *